US005937555A

United States Patent [19]

Query

[11] Patent Number: 5,937,555

[45] Date of Patent: Aug. 17, 1999

[54] LAMINATED THERMOPLASTIC YARD SIGN

[75] Inventor: Bradley L. Query, Cloverdale, Ind.

[73] Assignee: Patriot Signage, Incorporated, Dayton, Ky.

[21] Appl. No.: 08/951,567

[22] Filed: Oct. 16, 1997

[51] Int. Cl.[6] ..... G09F 15/00

[52] U.S. Cl. ..... 40/606; 40/610

[58] Field of Search ..... 40/603, 604, 610, 40/611, 775, 776, 734, 654.01, 661, 606, 559, 560; 383/109

[56] References Cited

U.S. PATENT DOCUMENTS

| | | | |
|---|---|---|---|
| 4,009,532 | 3/1977 | Thomas | 40/606 X |
| 4,259,803 | 4/1981 | Sittler | 40/610 X |
| 4,771,560 | 9/1988 | Richards | 40/607 |
| 5,184,896 | 2/1993 | Hammond et al. | 383/33 |
| 5,566,483 | 10/1996 | Ogren | 40/564 |
| 5,878,517 | 3/1999 | Gill | 40/606 |

*Primary Examiner*—Brian K. Green
*Assistant Examiner*—Rodrigo J. Morales
*Attorney, Agent, or Firm*—Wood, Herron & Evans, LLP

[57] ABSTRACT

An opaque plastic yard sign is formed from translucent outer layers that carry the indicia of the sign. Between the translucent outer layers is an opaque inner layer which is bonded to the two outer sides by lateral seals, and bonded to one of the outer layers by a horizontal bottom heat seal, leaving an opening for insertion of a wire frame. Preferably the liner includes an upper flap to provide added strength and rigidity to the upper portion of the sign. This reduces the overall cost of the sign while at the same time preventing light transmission from one side through the other without the need of coextruded films.

5 Claims, 2 Drawing Sheets

LAMINATED THERMOPLASTIC YARD SIGN

BACKGROUND OF THE INVENTION

Yard signs take on a variety of different configurations. The original yard signs were basically printed cardboard supported by wooden stakes. More recently, yard signs printed on flexible plastic film have been used. Such yard signs are supported by a U-shaped wire frame or wicket which is forced into the ground and the yard sign, which is in the configuration of a plastic sleeve, is placed over the wire wicket, holding it in place. The yard sign is generally printed on both sides so it can be viewed from two different directions. However, plastic can be relatively translucent. Thus, if a single layer of plastic is employed as a yard sign, the sunlight will cause the printing on one side to be viewable from the opposite side, making the yard sign relatively unattractive and difficult to read.

In order to eliminate this problem, yard signs have been formed from coextruded plastic. The inner layer is generally a very opaque material with the outer layer being white. Coextruded plastics are expensive and of course there are limitations associated with using coextruded plastic such as compatibility of the layers and the like.

An alternative to using coextruded plastic is to use two separate unlaminated films. This is basically a bag within a bag approach. Such a configuration is relatively time consuming to manufacture and unless done very properly is not attractive. It does not permit the sign to be held in a stretched configuration within the wicket and therefore has not met with commercial success.

SUMMARY OF THE INVENTION

The present invention is premised on the realization that a plastic yard sign can be formed from a single layer film by incorporating an integral inner liner. The integrated inner liner is primarily a single layer opaque film that has a flap or fold at the top portion of the sign. The single layer liner is heat sealed to the sides of the sign and to one bottom edge of the sign. This, in effect, produces an opaque sign. Further, this integrated liner with its upper flap or fold increases the overall strength and rigidity of the sign enhancing its aesthetic appearance. Further, the cost of this single-layer configuration is significantly less than coextruded film. The inner liner can be produced from recycled plastic such as polyethylene, significantly reducing the cost of the material. Due to its construction, the sign of the present invention can be produced very inexpensively. Further, variations of the overall thickness and strength of the sign can be made easily without redesign. Finally, the integrated liner results in a truer white substrate with more vivid colors since the coextruded film is not used. The coextruded film tends to dull white substrates.

The objects and advantages of the present invention will be further appreciated in light of the following detailed drawings and descriptions in which:

DETAILED DESCRIPTION

Figure 1:
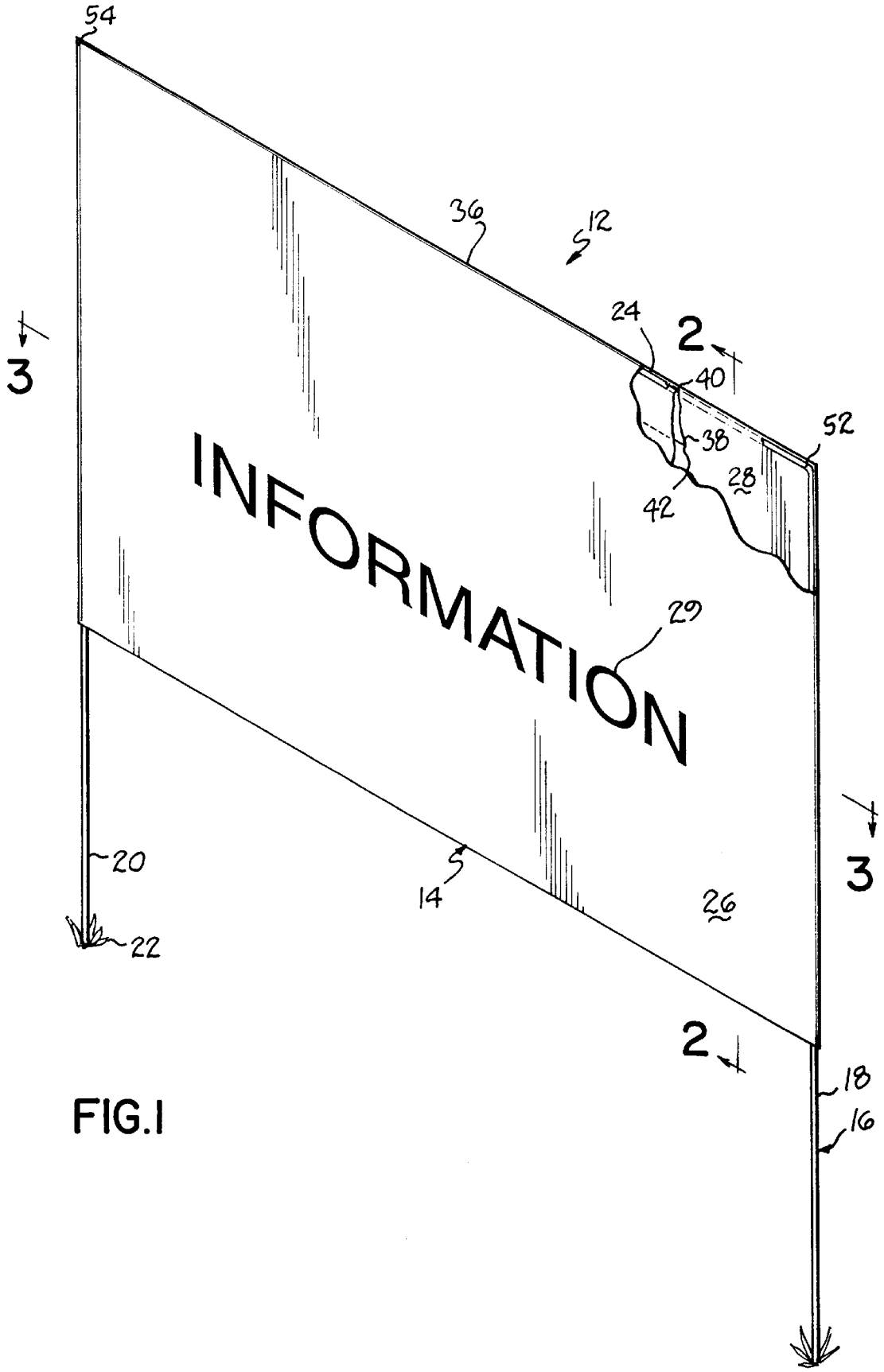
FIG. 1 i s a perspective view of the present invention partially broken away.
Figure 2:
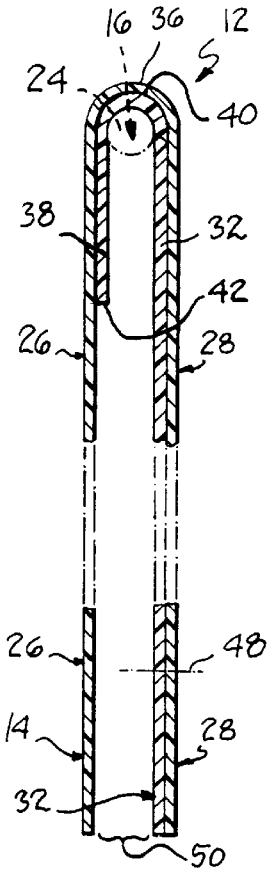
FIG. 2 is a cross-sectional view taken at lines 2—2 of FIG. 1.
Figure 3:
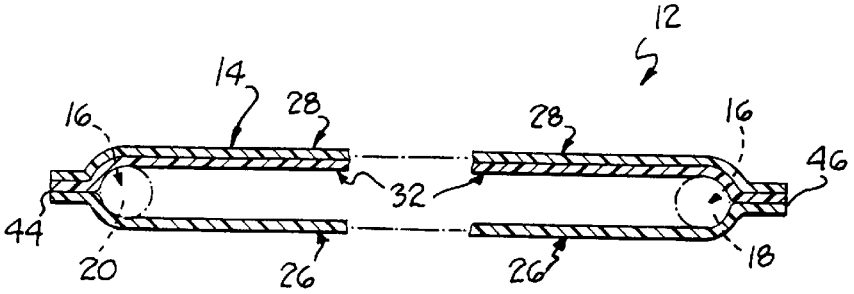
FIG. 3 is a cross-sectional view taken at lines 3—3 of FIG. 1.

The present invention is a yard sign 12 which includes a plastic sign 14 supported on a wire frame 16, also referred to as a "wicket." The wicket includes a first leg 18 and a second leg 20 which are inserted into the ground 22 to support the plastic sign 14.

The plastic sign 14 is a single sheet of plastic folded about a top edge 36 to form a first side 26 and a second side 28. As shown, indicia 29 is printed on each side (only one side shown).

The first side 26 of sign 14 is a single layer of plastic and the second side 28 of plastic sign 14 has an inner sheet 32. The inner sheet 32 is coextensive with the side 28, and includes an upper fold or flap portion 38. Upper flap portion 38 preferably extends from fold 40 toward side 26. Although in an alternate embodiment it could fold inwardly toward the side 28. The flap 38 has a lower edge 42 which extends 1–3" below fold 40. The side 28 sheet 32 and side 26 are held together by heat seals 44 and 46 at opposite sides of sign 14. Further, side 28 and inner sheet 32 are further bonded together by a bottom heat seal 48. This leaves an opening 50 between inner sheet 32 and the first side 26.

The different sheets can be formed from a variety of different plastics. The first and second sides 26 and 28 should be formed from a plastic that will accept print. Generally, it will have a desired color such as white, although other colors can certainly be employed as desired. The plastic will generally be a thermoplastic material, generally polyethylene.

The inner material can be formed from a variety of different opaque plastic films. Accordingly, it is highly filled. Further, it merely needs to be heat-sealable to the outer sheets and accordingly can also be selected from a variety of different plastics. Preferably, it is as inexpensive a plastic as possible, and generally will be recycled polyethylene. The thickness of the respective materials can vary. The thicker the material, the more expensive. However, increased thickness provides a more rigid sign which has a better aesthetic appearance. Generally, the thickness of the inner and outer sheets will be 2 to about 4 mm.

To form the sign of the present invention, the sheet that forms sides 26 and 28 is unrolled from the printed roll. The layer that forms inner sheet 32 is unrolled at the same time thus positioning them together with the upper edge 36 folded and heat seals 44, 46 and 48 are formed. The heat sealing also cuts the film forming the individual signs. This sign 14 is then placed over the wire frame 16. The corners of the wire wicket 52 will nest or lodge in the corners 54 of sign 14 with the cross-member 24 resting in the fold portion 38. The legs are inserted into the ground. Adhesive can be used in place of the heat seals if desired, but this is less preferable.

The sign of the present invention is vastly superior to prior plastic yard signs and of course provides an opaque sign which prevents the indicia on one side of the sign from being seen from the opposite side. Further, the inner liner with the upper flap results in a significant improvement in strength and rigidity, especially at the top and corners of the sign. The wire frame tends to nest in the fold which provides additional protection.

This is all accomplished while at the same time reducing costs. The inner liner can be formed from a very inexpensive material such as recycled polyethylene. Further, it eliminates the need for very expensive coextruded films. Further, it provides for a wide variety of different film thicknesses which can be easily varied to provide either relatively rigid signs or very flexible signs, depending upon the intended application.

The preceding has been a description of the present invention along with preferred methods of practicing the present invention. However, the invention itself should only be defined by the appended claims wherein we claim:

1. A plastic yard sign supported by a frame comprising:

a first sheet folded at a first edge to form a first side and a second side;

a linear sheet between said first side and said second side;

first and second side vertical seals bonding said first side and said second side and said liner sheet together;

a third bottom seal bonding only said second side and said liner sheet together, thereby providing a bottom opening;

wherein said frame is positioned in said sign between said first side and said liner sheet thereby supporting said sign, said frame extending out of said sign.

2. The yard sign claimed in claim 1 wherein said liner sheet includes a flap extending from a horizontal fold at said top edge.

3. The yard sign claimed in claim 2 wherein said liner sheet is opaque and said first sheet is translucent.

4. The yard sign claimed in claim 3 wherein said liner sheet is polyethylene.

5. The yard sign claimed in claim 2 wherein said flap extends between said inner liner and first side said flap having a liner edge located between said inner liner and said first side wherein said liner edge is not bonded to said first or second sides.

* * * * *